US011291270B2

(12) United States Patent
Montross et al.

(10) Patent No.: US 11,291,270 B2
(45) Date of Patent: Apr. 5, 2022

(54) ARTICLE OF FOOTWEAR HAVING CUSHIONING SYSTEM

(71) Applicant: Reebok International Limited, London (GB)

(72) Inventors: Matthew J. Montross, Middleboro, MA (US); John S. Greenhalgh, Foxboro, MA (US)

(73) Assignee: Reebok International Limited, London (GB)

( * ) Notice: Subject to any disclaimer, the term of this patent is extended or adjusted under 35 U.S.C. 154(b) by 101 days.

(21) Appl. No.: 16/685,748

(22) Filed: Nov. 15, 2019

(65) Prior Publication Data

US 2021/0145117 A1 May 20, 2021

(51) Int. Cl.
*A43B 13/20* (2006.01)
*A43B 13/18* (2006.01)

(52) U.S. Cl.
CPC ..... *A43B 13/20* (2013.01); *A43B 13/18* (2013.01)

(58) Field of Classification Search
CPC ..... A43B 13/20; A43B 13/18
USPC ..... 36/29
See application file for complete search history.

(56) References Cited

U.S. PATENT DOCUMENTS 2,682,712 A * 7/1954 Owsen ..... A43B 13/20 36/107
4,271,606 A * 6/1981 Rudy ..... A43B 13/223 36/29
4,999,931 A * 3/1991 Vermeulen ..... A43B 13/185 36/153
5,771,606 A 6/1998 Litchfield et al.
5,956,869 A * 9/1999 Kim ..... A43B 13/20 36/29
6,354,020 B1 3/2002 Kimball et al.
6,453,577 B1 9/2002 Litchfield et al.
6,510,624 B1 * 1/2003 Lakic ..... A43B 5/0407 36/28
6,976,321 B1 * 12/2005 Lakic ..... A43B 7/141 36/28
7,784,196 B1 8/2010 Christensen et al.
7,930,839 B2 4/2011 Litchfield et al.
10,016,017 B2 7/2018 Christensen et al.
10,178,891 B2 1/2019 Christensen et al.
10,932,519 B2 3/2021 Bates et al.
2004/0261293 A1 12/2004 Marvin et al.
2005/0132608 A1 * 6/2005 Dojan ..... A43B 13/20 36/29
2009/0151196 A1 * 6/2009 Schindler ..... A43B 13/12 36/29
2010/0251565 A1 10/2010 Litchfield et al.
2013/0167402 A1 * 7/2013 Christensen ..... A43B 13/184 36/29
2013/0212909 A1 * 8/2013 Bates ..... A43B 13/184 36/102

(Continued)

*Primary Examiner* — Marie D Bays
(74) *Attorney, Agent, or Firm* — Sterne, Kessler, Goldstein & Fox P.L.L.C.

(57) ABSTRACT

An article of footwear includes an upper and a sole coupled to the upper. The sole includes an upper sole, a fluid filled bladder coupled to the upper sole, and a plurality of recesses disposed between the upper sole and the bladder. The bladder includes a plurality of chambers extending below the upper sole. The plurality of chambers hold a fluid. Ambient air is disposed within the plurality of recesses between the upper sole and the bladder.

21 Claims, 15 Drawing Sheets

(56) References Cited

U.S. PATENT DOCUMENTS

| | | | | |
|---|---|---|---|---|
| 2014/0283413 | A1* | 9/2014 | Christensen | A43B 3/0057<br>36/102 |
| 2017/0245587 | A1 | 8/2017 | Bates et al. | |
| 2018/0070675 | A1* | 3/2018 | Campos, II | A43B 13/023 |
| 2018/0125160 | A1* | 5/2018 | Dojan | A43B 13/20 |
| 2018/0279718 | A1 | 10/2018 | Christensen et al. | |
| 2018/0338575 | A1* | 11/2018 | Elder | A43B 13/145 |
| 2018/0338577 | A1* | 11/2018 | Elder | A43B 13/145 |
| 2018/0338578 | A1* | 11/2018 | Elder | A43B 3/0052 |
| 2020/0154825 | A1* | 5/2020 | Case | A43B 13/188 |
| 2020/0154826 | A1* | 5/2020 | Case | A43B 13/206 |
| 2020/0375308 | A1* | 12/2020 | Langvin | A43B 13/16 |

* cited by examiner

ARTICLE OF FOOTWEAR HAVING CUSHIONING SYSTEM

BACKGROUND

Field of the Invention

The present disclosure relates to footwear, and more particularly relate to a sole and article of footwear having a fluid-filled bladder.

Background Art

The human foot possesses natural cushioning and rebounding characteristics. However, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole, which absorbs shocks. Therefore, a continuing need exists for innovations in providing cushioning to articles of footwear.

BRIEF SUMMARY OF THE INVENTION

The present disclosure includes various embodiments of a sole for an article of footwear that provides a desired cushioning effect to a wearer's foot.

In accordance with one embodiment, a sole for an article of footwear comprises an upper sole; a fluid filled bladder coupled to the upper sole, the bladder comprising a plurality of chambers extending below the upper sole; and a plurality of recesses disposed between the upper sole and the bladder, and wherein the plurality of recesses each define an air pocket between the upper sole and the bladder. In some embodiments each of the recesses is disposed between a respective chamber and the upper sole.

In some embodiments, the plurality of chambers comprises a set of peripheral chambers exposed along a lateral side of the sole or a medial side of the sole. In some embodiments, each of the peripheral chambers comprises an upper chamber surface, a bottom chamber surface, and a chamber sidewall, and the upper chamber surface comprises a recess indented toward the bottom chamber surface. In some embodiments, each of the recesses is defined by a respective recess formed in the upper chamber surface of a respective peripheral chamber.

In some embodiments, the upper sole comprises a plurality of bulges disposed along the lateral side of the sole and the medial side of the sole. In some embodiments, the upper sole comprises a plurality of bulges disposed along the lateral side of the sole and the medial side of the sole. In some embodiments, each of the bulges comprises a convex-shaped exterior surface protruding outward from the sole.

In some embodiments, the side chamber surface of each peripheral chamber extends continuously from the exterior surface of a respective bulge. In some embodiments, each of the bulges comprise ribs extending in a vertical direction. In some embodiments, the chamber sidewall of each peripheral chamber comprises ribs extending continuously from the ribs of a respective bulge.

In some embodiments, the set of peripheral chambers includes a lateral row of peripheral chambers disposed along the lateral side of the sole and a medial row of peripheral chambers disposed along the medial side of the sole. In some embodiments, the upper sole comprises an exposed outer lateral edge disposed along a lateral side of the sole. In some embodiments, the bladder extends beyond the exposed outer lateral edge of the upper sole such that the lateral row of peripheral chambers forms a lateral sidewall of the sole. In some embodiments, the upper sole comprises an exposed outer medial edge disposed along a medial side of the sole. In some embodiments, the bladder extends beyond the exposed outer medial edge of the upper sole such that the medial row of peripheral chambers forms a medial sidewall of the sole.

In some embodiments, the plurality of chambers comprises a central forefoot chamber disposed in a forefoot region of the sole between the medial and lateral rows of peripheral chambers. In some embodiments, the bladder comprises a plurality of forefoot conduits fluidly connecting the central heel chamber to the medial and lateral rows of peripheral chambers located in the heel region of the sole.

In some embodiments, the plurality of chambers comprises a central heel chamber disposed in a heel region of the sole between the medial and lateral rows of peripheral chambers. In some embodiments, the bladder comprises a plurality of heel conduits fluidly connecting the central heel chamber to the medial and lateral rows of peripheral chambers located in the heel region of the sole.

In some embodiments, the upper sole comprises a flat bottom sole surface and a projection extending along the bottom sole surface and disposed between the medial and lateral rows of peripheral chambers. In some embodiments, the projection includes a projection wall engaging against at least one peripheral chamber disposed along the lateral side of the sole and at least one peripheral chamber disposed along the medial side of the sole.

In accordance with one embodiment, an article of footwear comprises an upper; and a sole coupled to the upper. In some embodiments, the sole comprises an upper sole; a fluid filled bladder coupled to the upper sole, the bladder comprising a plurality of chambers extending below the upper sole; and a plurality of recesses disposed between the upper sole and the bladder, wherein ambient air is disposed within the plurality of between the upper sole and the bladder.

In some embodiments, the bladder is comprised of a blow-molded elastomeric material such that the lateral and medial sidewalls formed by the peripheral chambers are flexible.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

Figure 15:
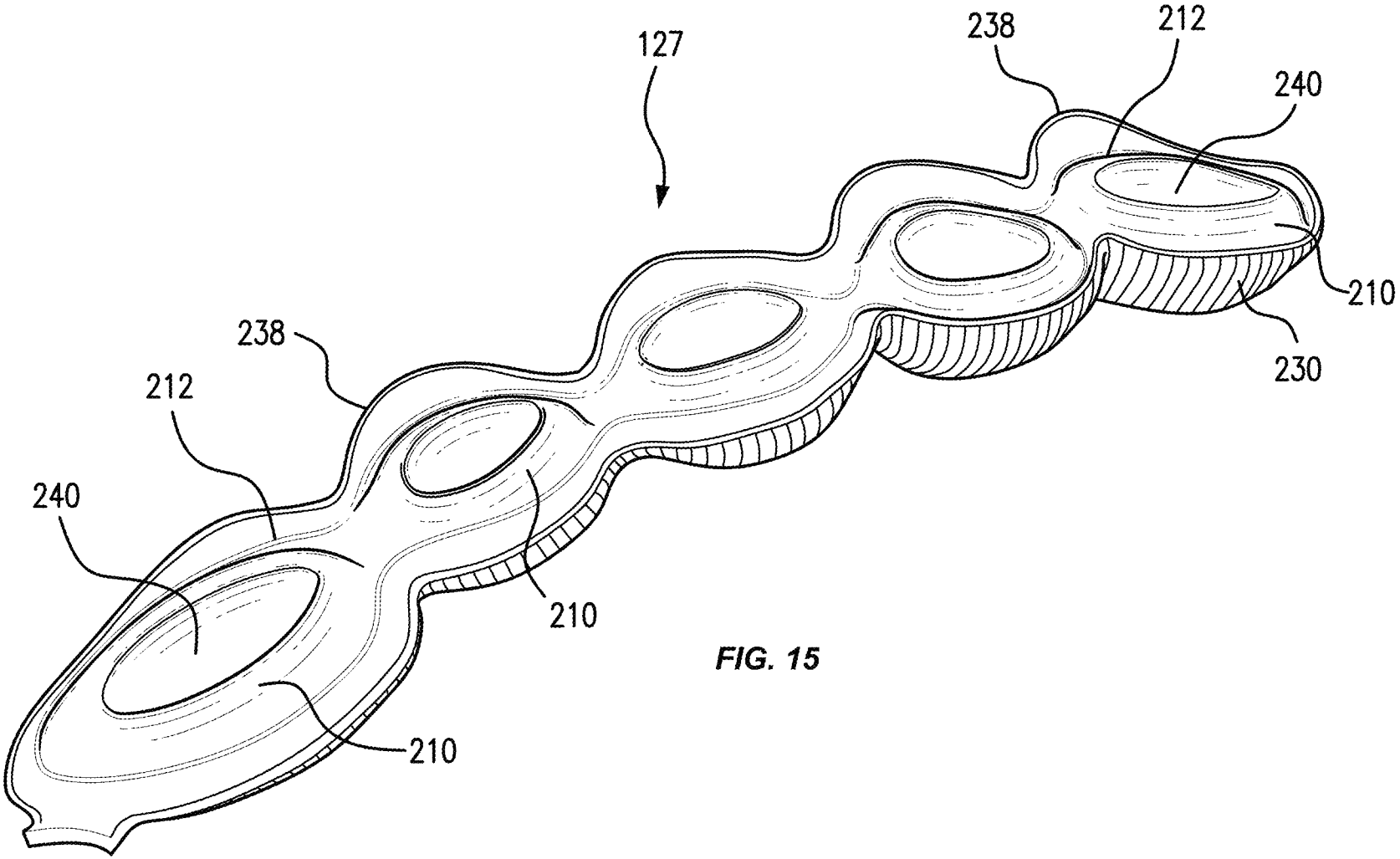

FIG. 15 a second perspective view of a lateral row of chambers for a bladder according to embodiment.

Figure 3:
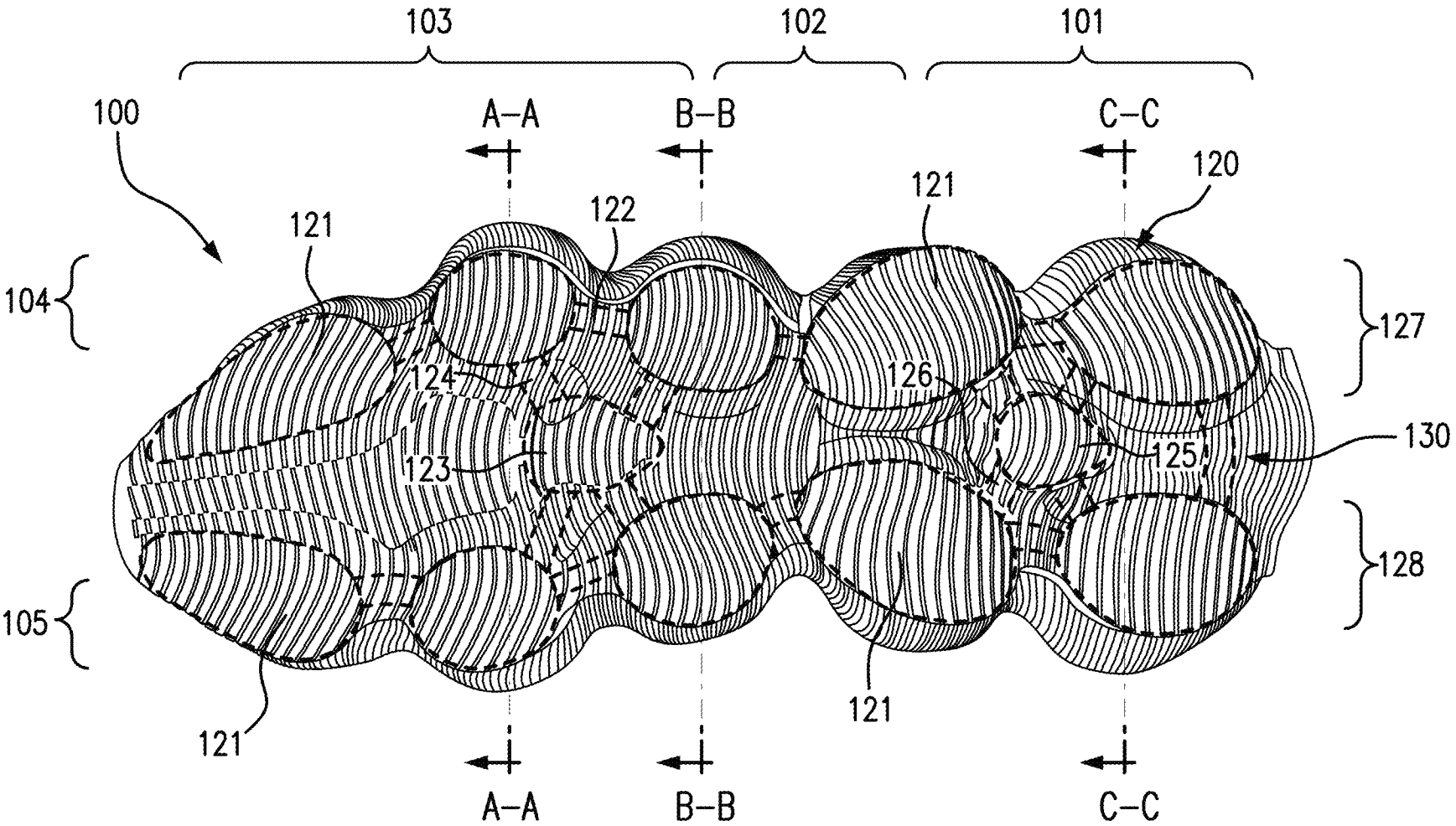
FIG. 3 shows a bottom view of an article of footwear according to embodiments.
Figure 16:
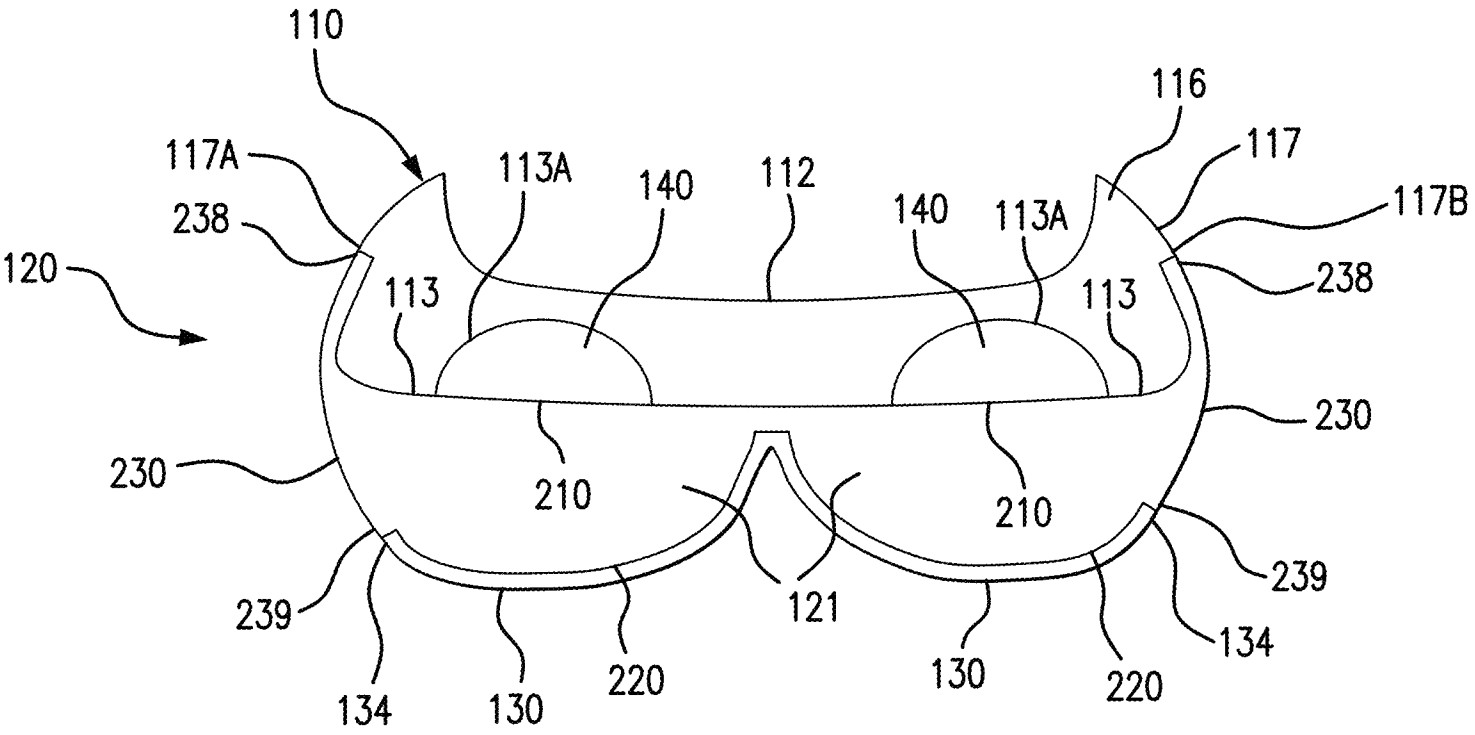

FIG. 16 is a cross-section view of an article of footwear taken along line C-C in FIG. 3 according to embodiments.

DETAILED DESCRIPTION OF THE INVENTION

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

One attempt over the years to improve cushioning and resiliency of shoes is incorporating a multi-chamber pod in the shoe sole so that air is transferred between the heel and forefoot areas of a shoe during the wearer's gait motion. However, there are several difficulties associated with using a multi-chamber pod filled with pressurized fluid within a shoe sole. Namely, it is difficult to maintain consistent air pressure within the chambers of the pod due to leakage, thereby failing to provide the wearer's foot a stable cushioning effect. Consequently, performance of shoe soles employed with pressurized pods may be erratic at times, thereby compromising the performance of the shoe.

Unlike multi-chamber pods filled with pressurized fluid, fluid cushioning devices holding ambient air generally will not leak or lose as much as air due to the lack of pressure gradient between the fluid cushioning device and the ambient environment. However, shoe soles employing ambient air-filled fluid cushioning devices typically fail to provide the dynamic cushioning effects achieved by pressurized pods during the wearer's gait cycle.

Accordingly, there is a need for an improved fluid cushioning sole that provides dynamic cushioning support to the wearer's foot during the wearer's gait cycle, while still having pockets of ambient air disposed within the sole (e.g., fluid-filled bladder pod with air pockets) so that the shoe sole still provides a stable cushioning effect to the wearer's foot during limited foot movement.

According to various embodiments described herein, the sole of the present disclosure may overcome one or more of the deficiencies noted above by comprising an upper sole, a fluid-filled bladder coupled to the upper sole, and one or more recesses disposed between the upper sole and the bladder. One or more of the recesses defines an air pocket between the bladder and the upper sole. The recesses and the chambers of the bladder together provide a desired cushioning effect to the wearer's foot, while maintaining a stable fluid transfer between the chambers of the bladder.

Figure 1:
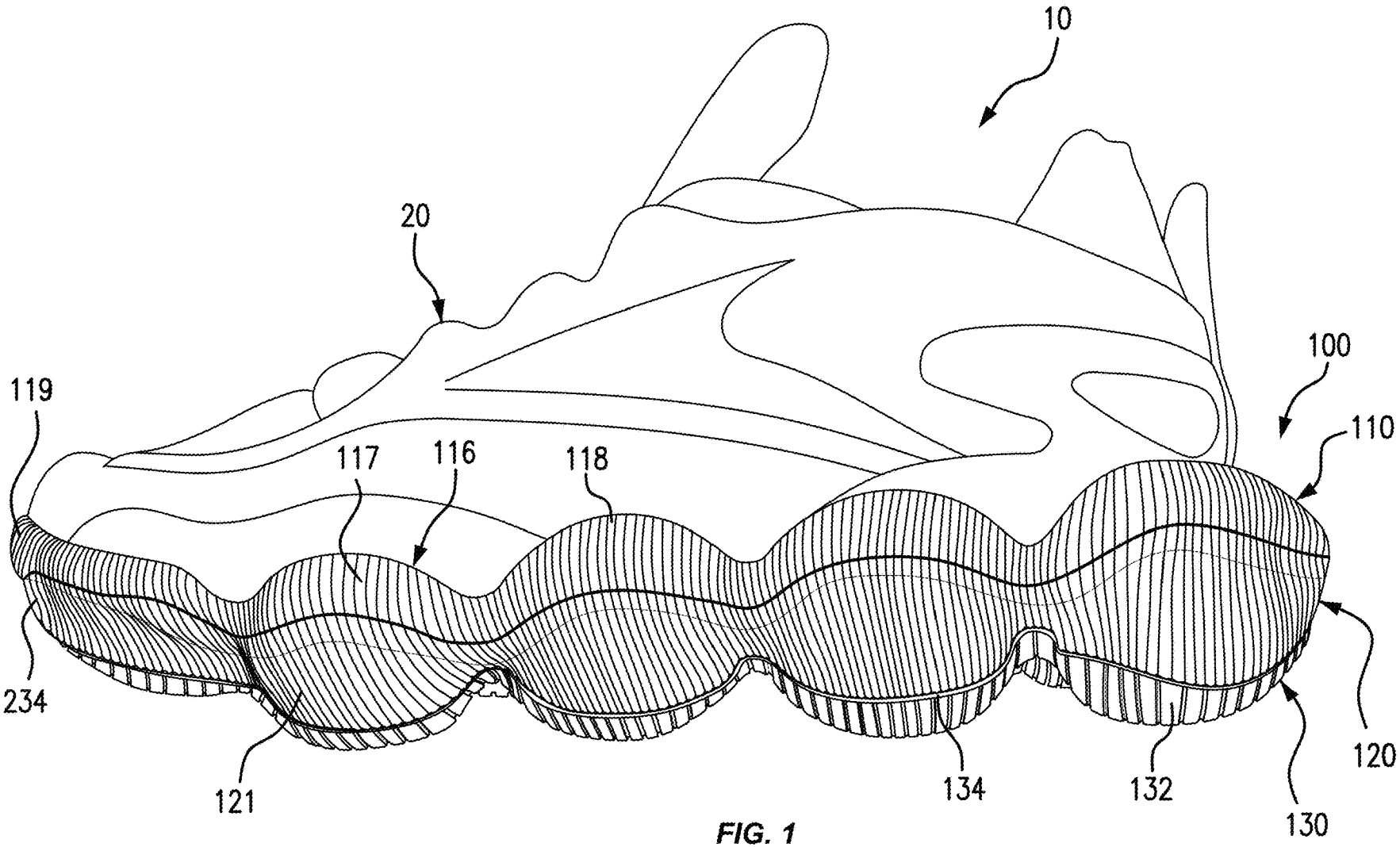
FIG. 1 shows a side view of an article of footwear according to embodiments.

FIGS. 1-7 illustrate an article of footwear 10 having an upper 20 and a sole 100 coupled to the upper 20 according to one embodiment of the present disclosure. In various embodiments, sole 100 may include a heel region 101, a midfoot or arch region 102, and a forefoot region 103 extending between a lateral side 104 and a medial side 105 of sole 100. In some embodiments, as shown in FIG. 1, for example, sole 100 may include an upper sole 110 coupled to upper 20 and a bladder 120 disposed below and coupled to upper sole 110. In some embodiments, sole 100 may include a lower sole 130 is disposed below and coupled to bladder 120. In various embodiments, bladder 120 may include a pod assembly of fluid-filled chambers fluidly connected in series such that bladder 120 allows the stored fluid to flow in a manner complementary to the wearer's stride and to the forces applied to the anatomical structure of the wearer's foot.

Figure 4:
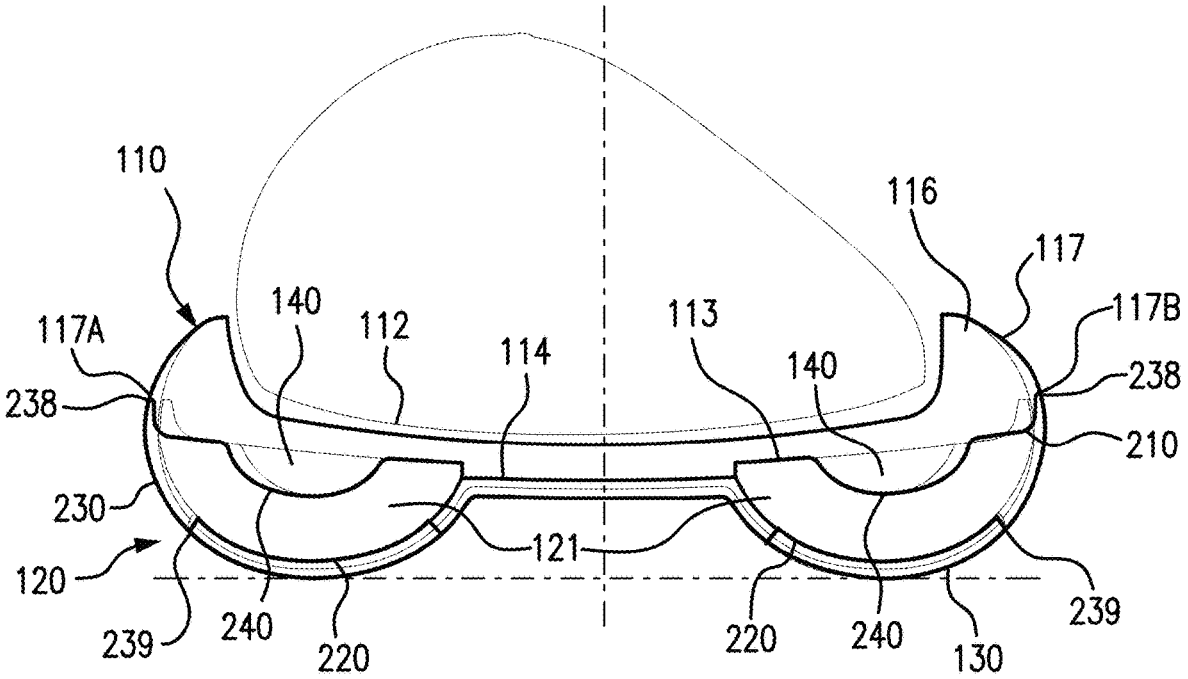
FIG. 4 shows a cross-section view of an article of footwear taken along line A-A in FIG. 3 according to embodiments.
Figure 5:
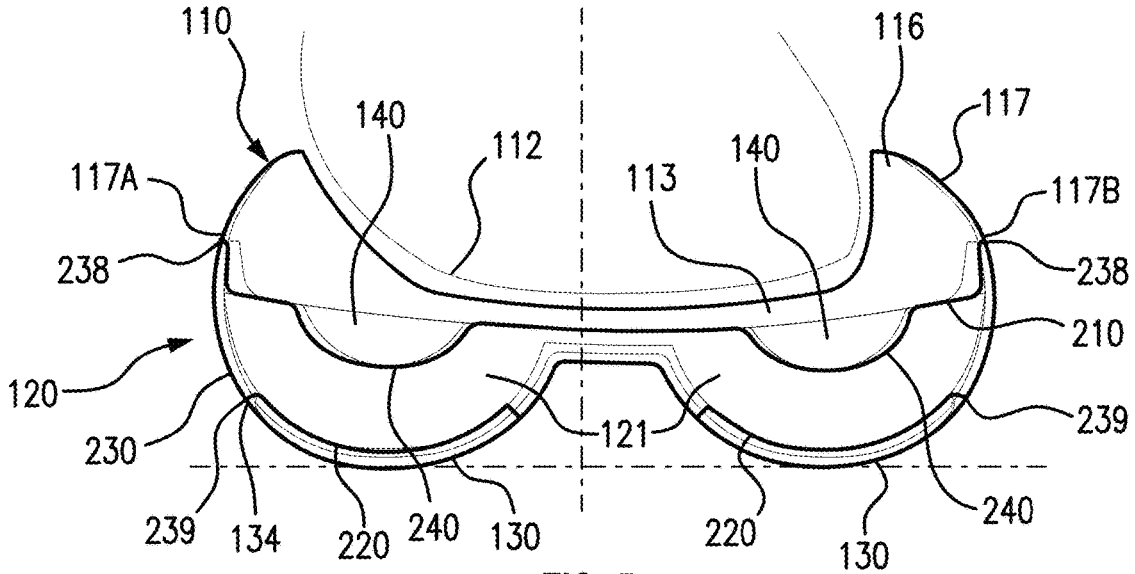
FIG. 5 shows a cross-section view of an article of footwear taken along line B-B in FIG. 3 according to embodiments.
Figure 6:
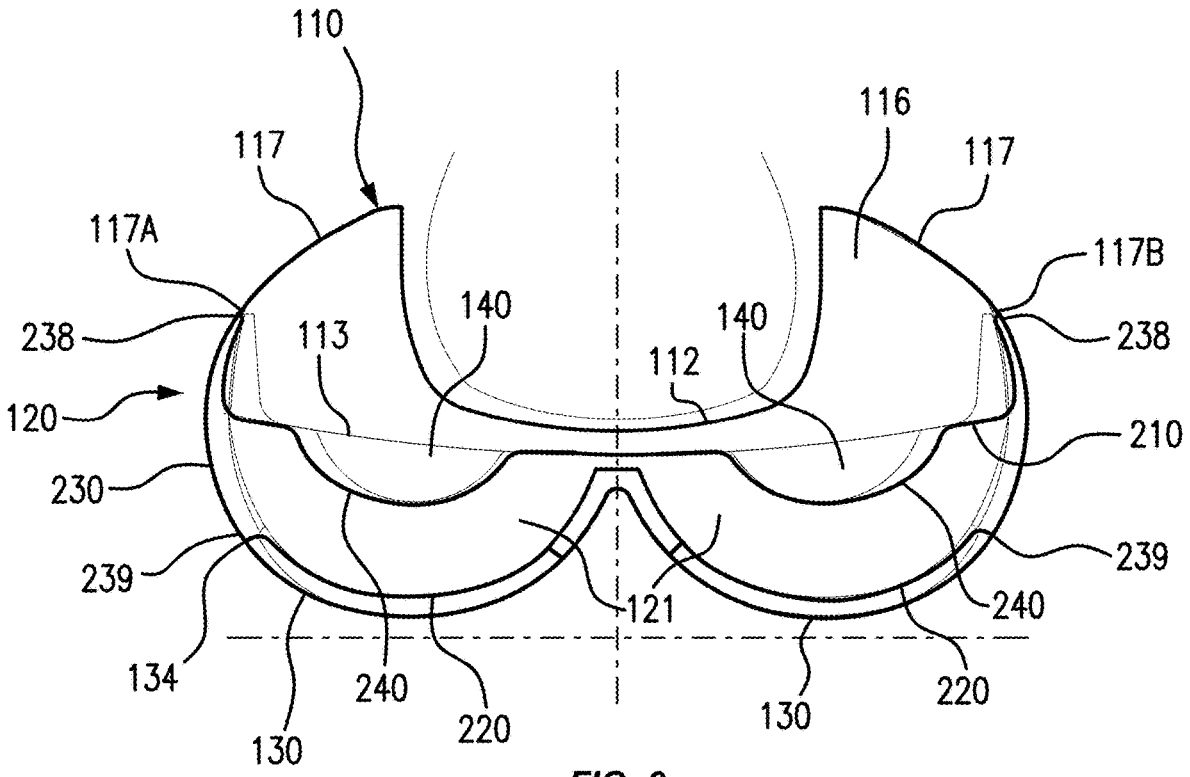
FIG. 6 shows a cross-section view of an article of footwear taken along line C-C in FIG. 3 according to embodiments.
Figure 7:
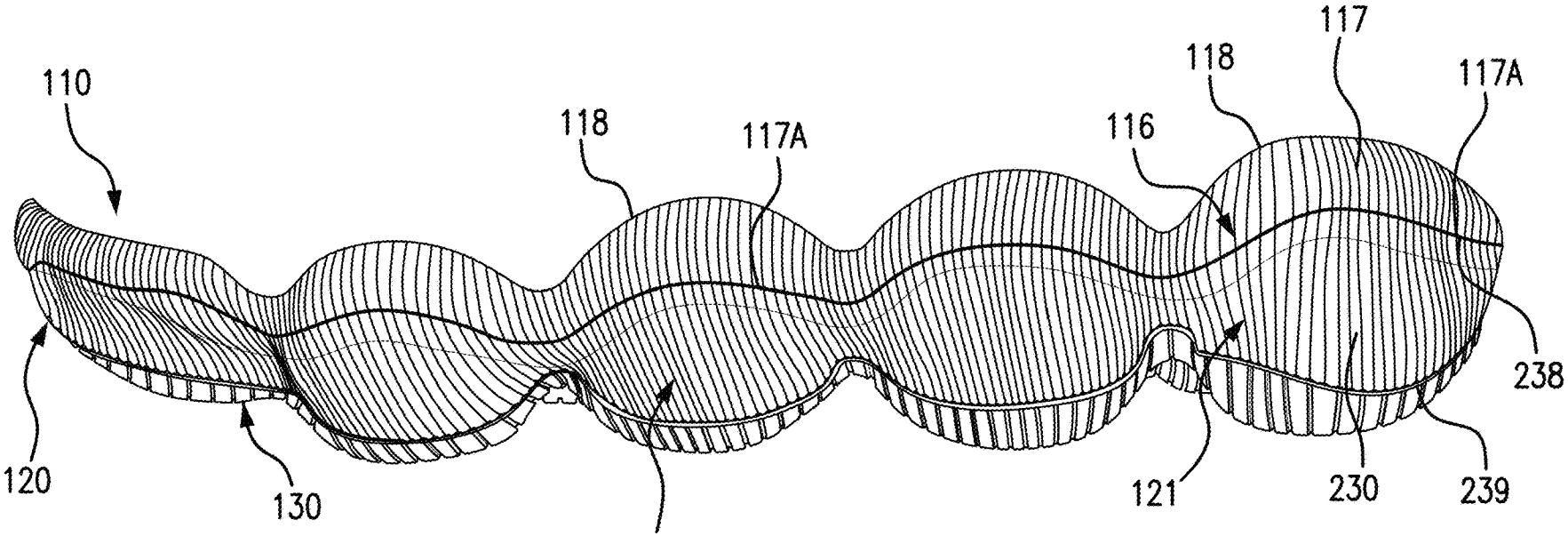
FIG. 7 shows a side view of a sole for an article of footwear according to embodiments.

In various embodiments, as shown in FIGS. 4-6 for example, sole 100 may include a plurality of recesses 140 disposed between upper sole 110 and bladder 120. In various embodiments, each recess 140 defines an air pocket disposed between upper sole 110 and bladder 120, such that ambient air is disposed within each recess 140. In various embodiments, the air pockets defined by recesses 140 provide a stable cushioning effect to the wearer's foot. In some embodiments, recesses 140 may be extended into bladder 120 to define air pockets between upper sole 110 and bladder 120. In some embodiments, recesses 140 may be extended into upper sole 110 to define air pockets between upper sole 110 and bladder 120. In some embodiments, recesses 140 may be extended into both upper sole 110 and bladder 120 to define air pockets between upper sole 110 and bladder 120. In various embodiments, each recess 140 is disposed entirely within a perimeter of bladder 120 so that ambient air disposed in recess 140 may act in concert with pressurized air held in bladder 120 to provide a desired cushioning effect to wearer's foot.

In various embodiments, the arrangement, size, and shape of the recesses 140 may be adapted to provide a desired cushioning effect to a wearer's foot and stabilize air flow within bladder 120. In various embodiments, upper sole 110 and bladder 120 may be adapted to alter the arrangement, size, and shape of the recesses 140, as described herein.

Figure 2:
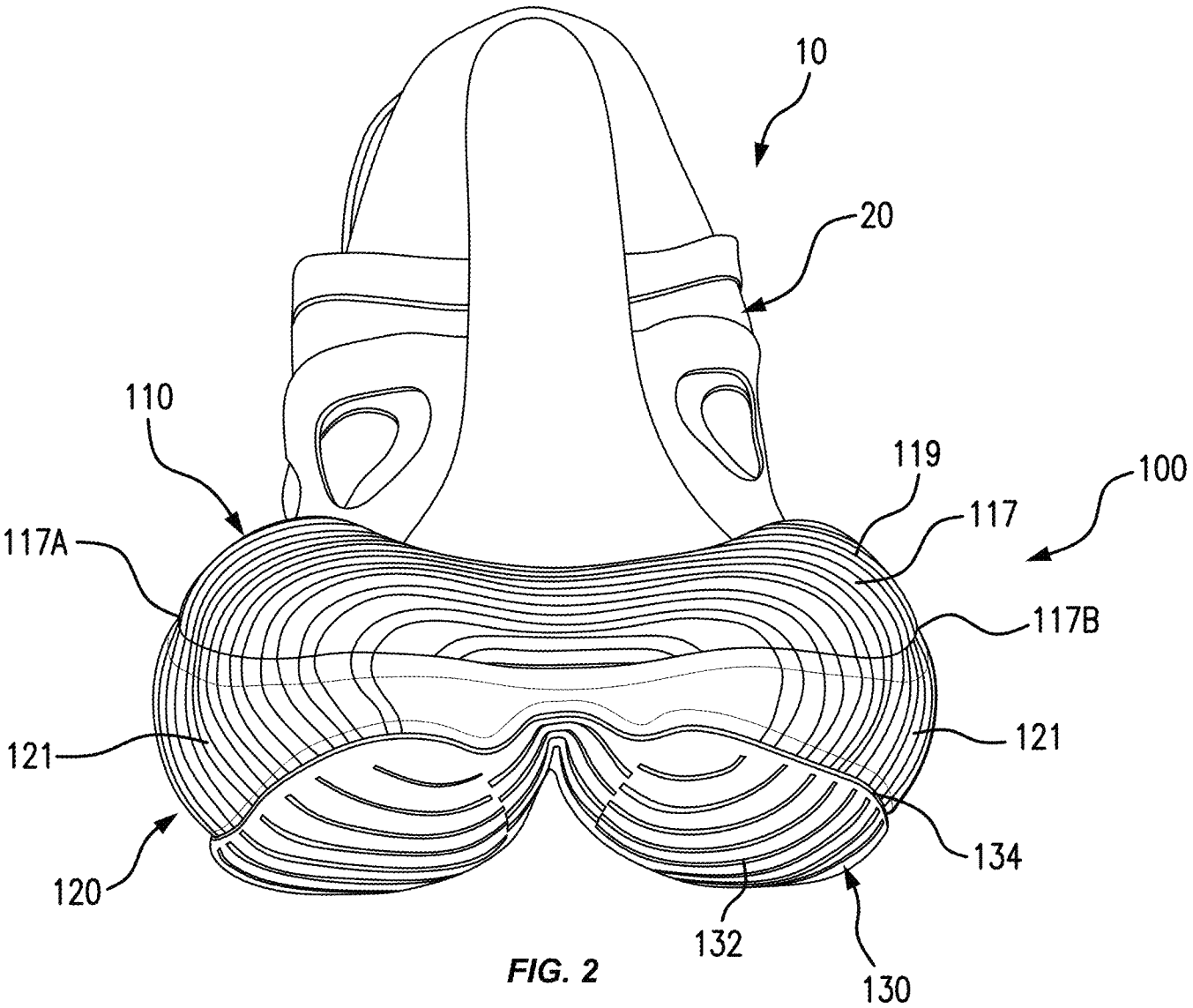
FIG. 2 shows a rear view of an article of footwear according to embodiments.

In some embodiments, with reference to FIGS. 1 and 2, for example, upper sole 110 may be attached to the upper 20 by adhesive bonding, welding, or any other suitable technique. In some embodiments, as shown in FIGS. 4-6 and 8, for example, upper sole 110 may include a top surface 112 generally shaped to accommodate the contours of the foot. In some embodiments, as shown in FIGS. 4-6 and 9, for example, upper sole 110 may include a flat bottom surface 113 and one or more projections 114 formed along bottom surface 113. In one embodiment, as shown in FIG. 9, for example, upper sole 110 may include a single projection 114 extending from along bottom surface 113 from heel region 101 to the forefoot region 103. In some embodiments, projection 114 may include a projection wall 115 sized and shaped to engage a portion of bladder 120 (e.g., a chamber of bladder 120). In some embodiments, projection 114 may define a ground-contacting surface comprising ridges 114A protruding downward away from sole 100 to increase strength of projection 114.

Figure 8:
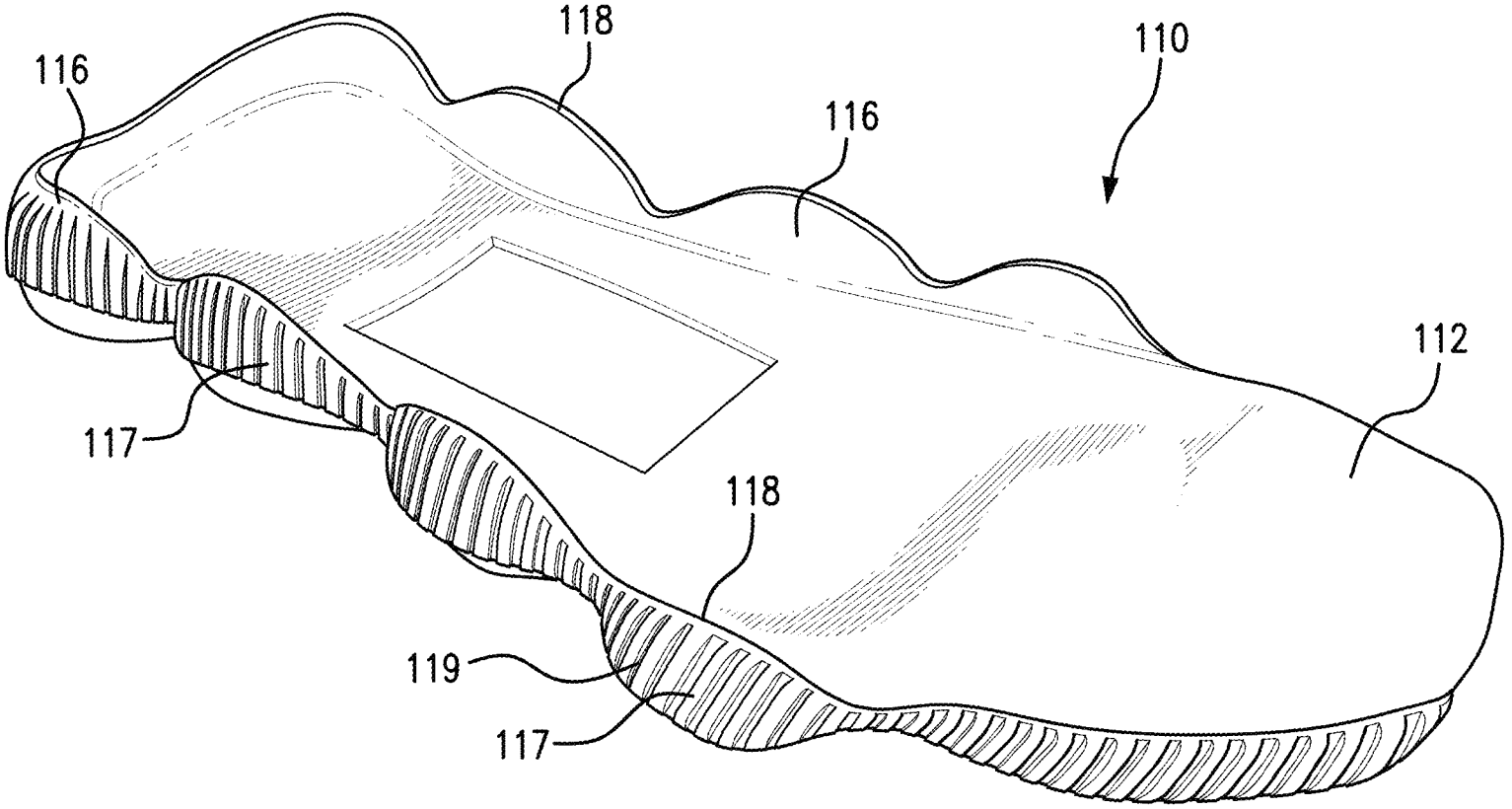
FIG. 8 shows a perspective view of the upper sole for a sole according to embodiments.
Figure 9:
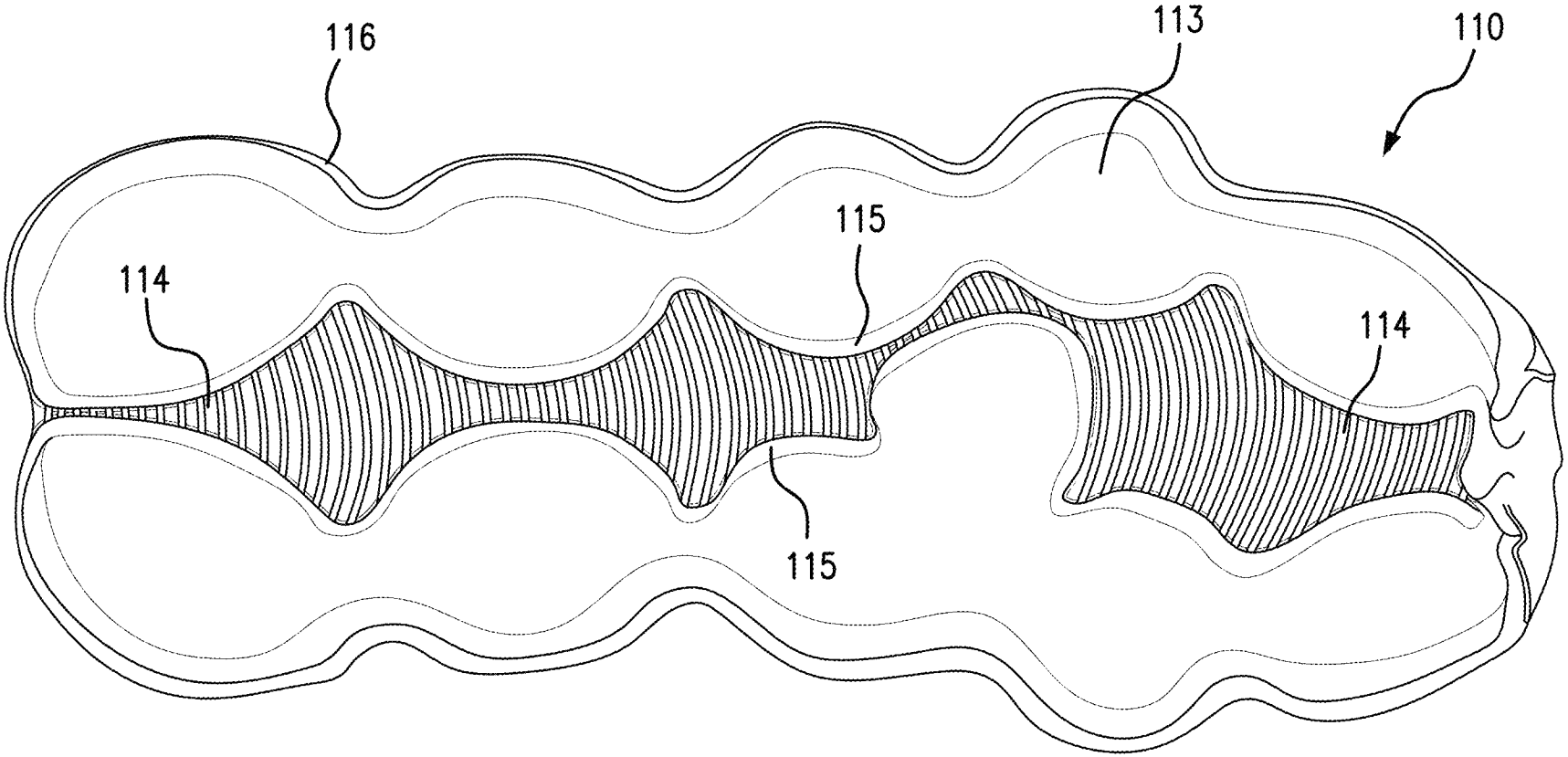
FIG. 9 shows a bottom view of the upper sole for a sole according to embodiments.

In some embodiments, as shown in FIGS. 1, 2, 4-6, 8, and 9, for example, upper sole 110 may include a plurality of bulges 116 disposed along lateral side 104 and medial side 105 of sole 100. In some embodiments, with reference to FIGS. 1, 2, 4-6, and 8, each bulge 116 may comprise a convex-shaped exterior surface 117 protruding outward from sole 100, where bulges 116 disposed along lateral side 104 of sole 100 define an exposed outer lateral edge 117A and bulges 116 disposed along medial side 105 of sole 100 define an exposed outer medial edge 117B. In some embodiments, as shown in FIGS. 1 and 8, for example, bulges 116 may define a corrugated-shaped upper edge 118 extending from heel region 101 to forefoot region 103 of sole 100. In some embodiments, as shown in FIGS. 1, 2, and 8, for example, plurality of bulges 116 comprise ribs 119 protruding from exterior surface 117 and extending in a vertical direction. In some embodiments, ribs 119 are configured to increase stiffness of the sides of the upper sole 110.

In various embodiments, upper sole 110 may be comprised of a foam material, such that the upper sole 110 is configured to absorb shock and provide cushion to wearer's foot. In some embodiments, upper sole 110 may be comprised of a foam-based material that includes ethylene vinyl acetate (EVA). In some embodiments, upper sole 110 comprises thermoplastic urethane (TPU). In some embodiments, upper sole 110 comprises expanded thermoplastic foam, such as, for example, expanded thermoplastic urethane (eTPU). In embodiments, upper sole 110 may be comprised of a foam-based material that includes materials, such as elastomers, thermoplastic elastomers, foam-like plastic, and gel-like plastics. In some embodiments, upper sole 110 may be comprised of an open-cell foam-based material or a closed-cell foam-based material.

In various embodiments, bladder 120 may be comprised of an elastomeric, resilient material and filled with a fluid such that bladder 120 is configured to compress upon the application of force and expand with the delivery of a fluid, thereby providing continuous cushioning support for wearer's foot. In some embodiments, bladder 120 may be fluid-filled. In some embodiments, bladder 120 is filled with ambient air. In some embodiments, bladder 120 may be filled with air set at a pressure above ambient pressure, such as, for example, in a range between 4 psi and 8 psi above ambient pressure. In some embodiments, bladder 120 may be filled with other types of gases, such as helium or nitrogen. In some embodiments, bladder 120 may further be filled with other materials, such as, for example, a gel, a paste, foam, a plurality of particles (e.g., polymer particles, eTPU particles, foam particles, cellulose particles, rock, or rubber particles), or a combination thereof. In various embodiments, bladder 120 may provide continuous cushioning to the wearer's foot such that a wearer's stride forces the fluid (e.g., air) or material (e.g., foam particles) within bladder 120 to flow in a manner complementary to the wearer's stride.

In some embodiments, bladder 120 may be comprised of a thermoplastic elastomer or a thermoplastic polyurethane. In other embodiments, bladder 120 may be comprised of other materials suitable for providing elastomeric, resilient properties, such as, for example, thermoplastic olefins, thermoplastic vulcanates, rubber, or a combination thereof. In some embodiments, bladder 120 may be formed by an extrusion blow-molded technique such that all the elements of the bladder 120, as described herein, are provided as a unitary "one-piece" component. In some embodiments, the blow-molded technique for forming the bladder 120 may include injection blow molding, stretch blow molding, or frame blow molding. In other embodiments, bladder 120 may be formed by other processes, such as, for example, thermoforming and sealing, injection molding and sealing, vacuum forming and sealing, or radio frequency/high frequency welding.

In various embodiments, with reference to FIG. 10, for example, bladder 120 comprises a plurality of fluid-filled chambers 121, 123, 125 extending below upper sole 110. In various embodiments, bladder 120 comprises a plurality of peripheral passages 122, a plurality of forefoot conduits 124, and a plurality of heel conduits 126 fluidly connecting the plurality of chambers such that fluid (e.g., air) may be diffused between the various chambers upon the application of force against sole 100.

In some embodiments, the plurality of chambers include a set of peripheral chambers 121 exposed along either lateral side 104 or medial side 105 of sole 100. In some embodiments, each peripheral chamber 121 is located directly beneath a respective bulge 116 of upper sole 110. In some embodiments, set of peripheral chambers 121 include a lateral row 127 of peripheral chambers 121 disposed along lateral side 104 of sole 100 and a medial row 128 of peripheral chambers 121 disposed along medial side 105 of sole 100. In some embodiments, lateral row 127 and medial row 128 of peripheral chambers 121 extend from heel region 101 to forefoot region 103 of sole 100.

In some embodiments, lateral row 127 and medial row 128 of peripheral chambers 121 are fluidly connected in series via peripheral passages 122 such that each pair of adjacent peripheral chambers 121 are interconnected by a respective peripheral passage 122. In some embodiments, as shown in FIG. 10, for example, peripheral chambers 121 disposed at the forward most end of lateral row 127 and medial row 128 are each directly connected to only one peripheral chamber 121. In some embodiments, as shown in FIG. 10, for example, peripheral chambers 121 disposed at the rearward most end of lateral row 127 and medial row 128 are directly connected together by a respective peripheral passage 122.

Figure 10:
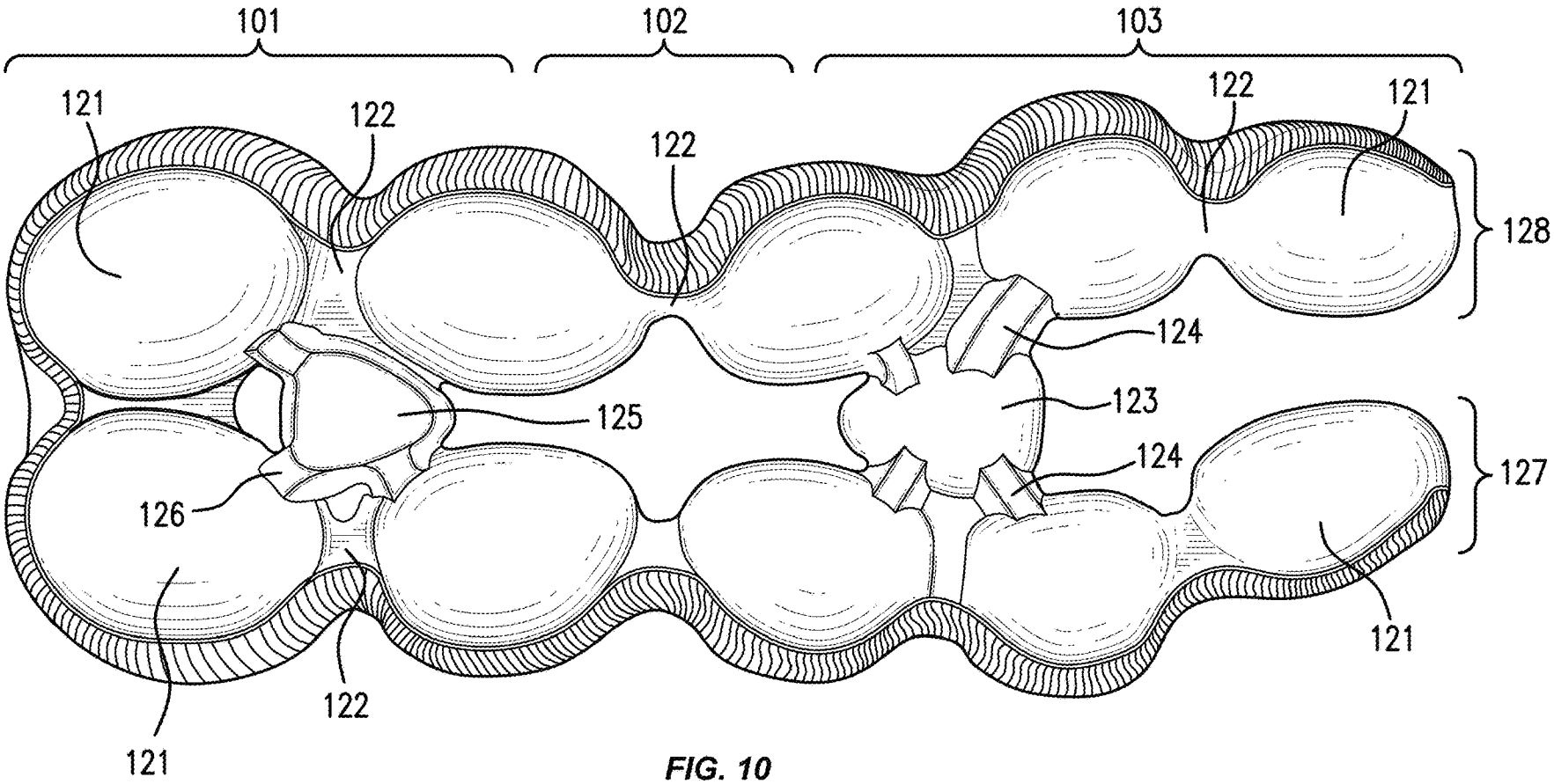
FIG. 10 shows a bottom view of a bladder for a sole according to embodiments.

In some embodiments, as shown in FIG. 10, for example, the plurality of chambers include a central forefoot chamber 123 disposed in forefoot region 103 of sole 100 between the lateral and medial rows 127, 128 of peripheral chambers 121. In some embodiments, plurality of forefoot conduits 124 are located in forefoot region 103 of sole 100 and fluidly connect central forefoot chamber 123 to at least one of peripheral chambers 121 disposed along the lateral row 127 and at least one of peripheral chambers 121 disposed along medial row 128. In one embodiment, as shown in FIG. 10, for example, bladder 120 includes a total of four forefoot conduits 124 that fluidly connect central forefoot chamber 123 to two peripheral chambers 121 disposed along later row 127 and two peripheral chambers 121 disposed along medial row 128.

In some embodiments, as shown in FIG. 10, for example, the plurality of chambers include a central heel chamber 125 disposed in heel region 101 of sole 100 between the lateral and medial rows 127, 128 of peripheral chambers 121. In some embodiments, plurality of heel conduits 126 are located in heel region 101 of sole 100 and fluidly connect central heel chamber 125 to at least one of peripheral chambers 121 disposed along the lateral row 127 and at least one of peripheral chambers 121 disposed along medial row 128. In one embodiment, as shown in FIG. 10, for example, bladder 120 includes a total of three heel conduits 126 that fluidly connect central heel chamber 125 to two peripheral chambers 121 disposed along later row 127 and a single peripheral chamber 121 disposed along medial row 128.

In some embodiments, the plurality of chambers include a central midfoot chamber disposed in midfoot region 102 of sole 100 between the lateral and medial rows 127, 128 of peripheral chambers 121. In some embodiments, the plurality of conduits include a set of midfoot conduits located in midfoot region 102 of sole 100 and fluidly connecting central midfoot chamber to at least one of peripheral chambers 121 disposed along the lateral row 127 and at least one of peripheral chambers 121 disposed along medial row 128.

In some embodiments, the cross-section opening formed along selective portions of peripheral passages 122, forefoot conduits 124, and heel conduits 126 may be reduced to control air flow between adjacent chambers. In one embodiment, for example, a portion of peripheral passages 122 located in midfoot region 102 of sole 100 may include an orifice so that upon heel strike, air in peripheral chambers 121 along heel region 101 gradually flows to peripheral chambers 121 along forefoot region 103, rather than flowing rapidly to peripheral chambers 121 along forefoot region 103. In some embodiments, bladder 120 may include valves at various locations in peripheral passages 122, forefoot conduits 124, and heel conduits 126 to regulate air flow between portions of the sole 100. In one embodiment, for example, valves may be disposed in peripheral passages 122 located in midfoot region 102 of sole 100 to substantially isolate the peripheral chambers in the heel region 101 of sole 100.

In some embodiments, with reference to FIGS. 4-6 and 11-15, for example, each peripheral chamber 121 may include an upper chamber surface 210 disposed against bottom surface 113 of upper sole 110, a bottom chamber surface 220 configured to engage a ground surface, and a chamber sidewall 230 extending from upper chamber surface 210 to bottom chamber surface 220. In some embodiments, upper chamber surface 210 defines a substantially oval shape. In other embodiments, upper chamber surface 210 may define other round shapes, such as a circle. In some embodiments, bottom chamber surface 220 defines a convex, curved shape bulging away from bottom surface 113 of upper sole 110. In some embodiments, chamber sidewall 230 defines a convex, curved shape bulging outwards, such that bottom chamber surface 220 and chamber sidewall 230 collectively define a rounded (e.g., semi-elliptical-shaped) edge that allows peripheral chamber 121 to gradually collapse under pressure. By gradually collapsing under pressure, peripheral chamber 121 forces stored fluid to flow to other locations along the bladder 120 while still providing cushioning support to wearer's foot. In some embodiments, sidewall 230 of each peripheral chamber 121 protrudes outward beyond outer lateral edge 117A and outer medial edge 117B of upper sole 110 to form a sidewall of sole 100.

In various embodiments, the size and shape of chamber sidewall 230 may be adapted to increase the structural integrity of peripheral chamber 121. For example, in some embodiments, chamber sidewall 230 comprises a transverse dimension (e.g. thickness) that is greater than a transverse dimension of either bottom chamber surface 220 and upper chamber surface 210. In some embodiments, the transverse dimension of chamber sidewall 230 may range from about 0.8 mm to about 3.5 mm, such as from about 1.5 mm to about 2.5 mm. In some embodiments, the transverse dimension of chamber sidewall 230 may vary based on the material compound used to form bladder 120. In some embodiments, the transverse dimension of chamber sidewall 230 may be set at a particular transverse dimension to provide a desired feel or effect to the wearer's foot. In some embodiments, chamber sidewall 230 includes ribs 234 protruding outward and extending in a vertical direction to increase the strength of chamber sidewall 230. In some embodiments, ribs 234 of each chamber sidewall 230 extend continuously from the ribs 219 of a respective bulge 116. In some embodiments, ribs 234 may be configured to add strength to bladder 120 so that bladder 120 may provide adequate against the wearer's foot while comprising less material and less weight. In some embodiments, the shape and design of ribs 234 may be configured to tailor cushioning characteristics provided by sole 100 according to a wearer's gait cycle. In some embodiments, the shape and design of ribs 234 may be configured to provide visual distinction or impact.

Figure 11:
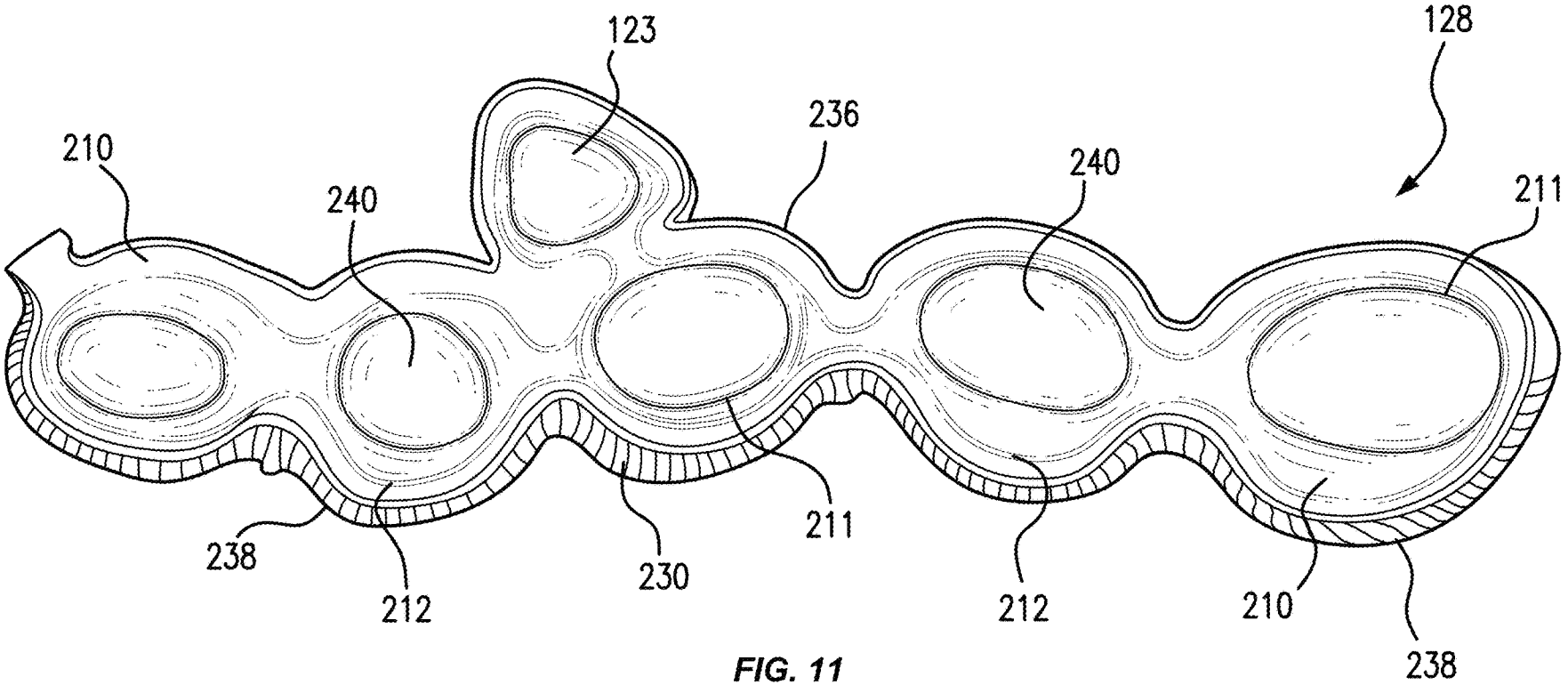
FIG. 11 shows a top view of a medial row of chambers for a bladder according to embodiments.
Figure 12:
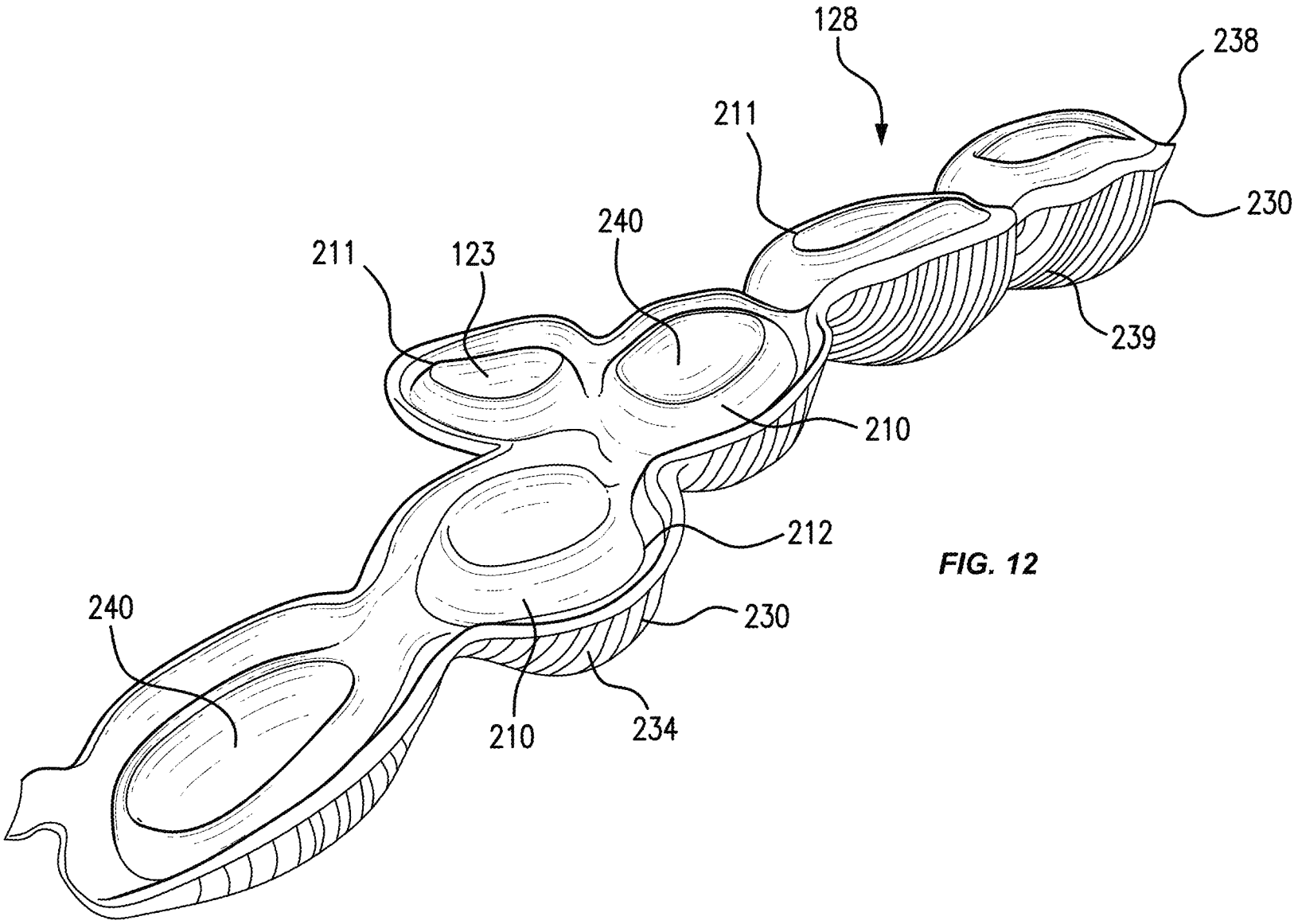
FIG. 12 shows a perspective view of a medial row of chambers for a bladder according to embodiments.
Figure 13:
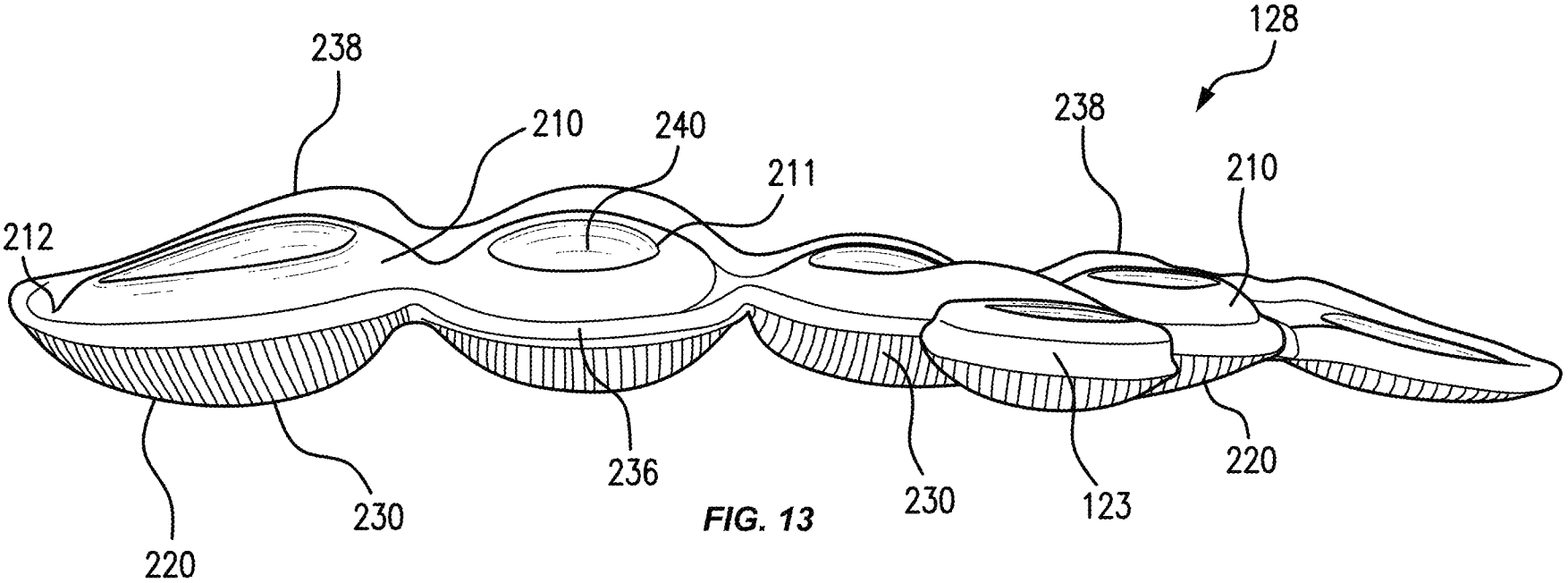
FIG. 13 shows a side view of a medial row of chambers for a bladder according to embodiments.
Figure 14:
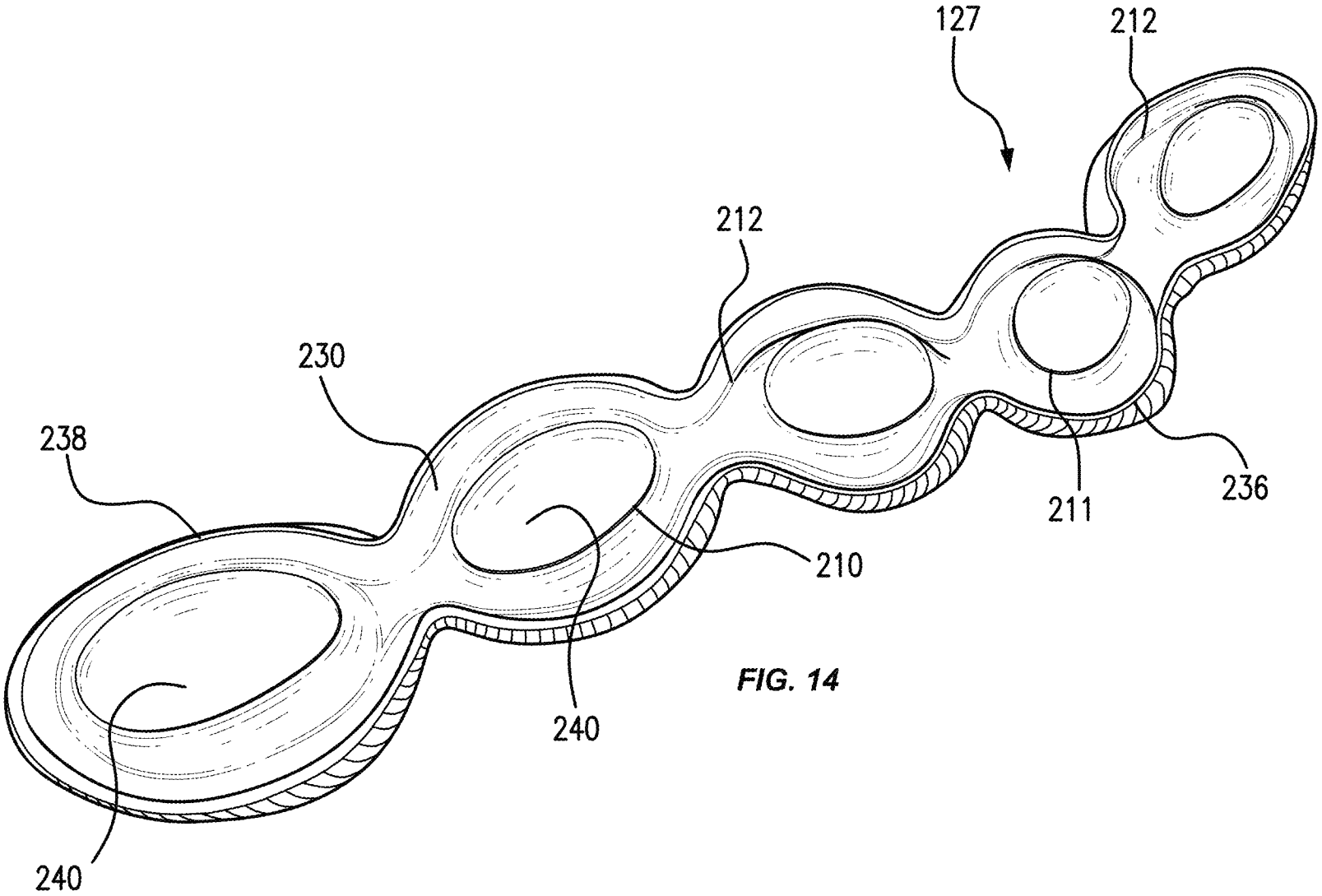
FIG. 14 shows a first perspective view of a lateral row of chambers for a bladder according to embodiments.

In various embodiments, the shape of peripheral chambers 121 may be adapted to promote snug contact with upper sole 110, thereby ensuring a secure connection between bladder 120 and upper sole 110. In some embodiments, as shown in FIGS. 11-15, for example, chamber sidewall 230 may extend above an outer edge of upper chamber surface 210 such that a groove 212 is defined along the outer edge of upper chamber surface 210. In some embodiments, a portion of upper sole 110 may be received in groove 212, such that upper sole 110 is partially contained by chamber sidewall 230. In some embodiments, as shown in FIGS. 11, 12, and 14, for example, chamber sidewall 230 may include a shoulder 236 protruding away from an inner edge of upper chamber surface 210. In some embodiments, a portion of projection 114 may engage shoulder 236 of sidewall 230 such that each peripheral chamber 121 is flushed against projection wall 115. In some embodiments, projection 114 of upper sole 110 may be disposed between lateral row 127 and medial row 128 of peripheral chambers 121 such that projection wall 115 engages peripheral chambers 121 disposed along lateral and medial sides 104, 105 of sole 100.

In some embodiments, with reference to FIGS. 4-6 and 9, for example, chamber sidewalls 230 of peripheral chambers 121 collectively define a corrugated-shaped upper edge 238 and a corrugated-shaped lower edge 239 that extend from heel region 101 to forefoot region 103 and corresponds to the shape of upper edge 118 defined by bulges 116 of upper sole 110. In some embodiments, upper edge 238 of peripheral chambers 121 is disposed flushed against outer lateral edge 117A and outer medial edge 117B of bulges 116 such that chamber sidewall 230 of each peripheral chamber 121 extends continuously from exterior surface 117 of bulges 116. In some embodiments, chamber sidewalls 230 of peripheral chambers 121 disposed along lateral row 127 protrude beyond outer lateral edge 117A of bulges 116 such that lateral row 127 of peripheral chambers 121 form a lateral sidewall of sole 100. In some embodiments, chamber sidewalls 230 of peripheral chambers 121 disposed along medial row 128 protrude beyond outer medial edge 117B of bulges 116 such that medial row 128 of peripheral chambers 121 form a medial sidewall of sole 100.

In some embodiments, as shown in FIGS. 4-6, upper chamber surface 210 includes a recessed portion 240 indented toward bottom chamber surface 220 such that bottom surface 113 of upper sole 110 and recessed portion 240 of upper chamber surface 210 collectively define the outer boundary of recess 140. In some embodiments, recess 140 may hold ambient air held between recessed portion 240 of upper chamber surface 210 and bottom surface 113 of upper sole 110. In some embodiments, the ambient air disposed in recess 140 may be at a pressure lower than the pressure of fluid held in bladder 120. In some embodiments, peripheral chamber 121 may hold a volume of fluid (e.g., air) greater than the volume of ambient air held in recess 140.

In some embodiments, ambient air disposed in recess 140 may act in concert with pressurized air held in peripheral chamber 121 to provide a desired cushioning effect to wearer's foot. For example, in some embodiments, recess 140 and peripheral chamber 121 may be configured to provide a dual phase cushioning system by the ambient air disposed in recess 140 providing a baseline cushion against the wearer's foot and the air stored in peripheral chamber 121 providing additional support against the wearer's foot. In some embodiments, air disposed in recess 140 may support upper chamber surface 210 such that the arrangement between recess 140 and peripheral chambers 121 provides a more stable platform. In some embodiments, the dual phase cushioning system furnished by recesses 140 and peripheral chambers 121 may provide a smoother and more supportive feel compared to previous single stage bladder systems.

In some embodiments, recessed portion 240 may define a shape corresponding to the shape (e.g., semi-elliptical) of bottom chamber surface 220. In some embodiments, recessed portion 240 may define an opening along upper chamber surface 210 with a shape corresponding to the shape (e.g., oval) of upper chamber surface 210. In some embodiments, recessed portion 240 may define other shapes, such as circular, semi-spherical, oblong, conical, tubular, parabolic, sinusoidal, tapered, sinusoidal, polyhedral (e.g., cubical), rounded, and trough. In some embodiments, recessed portion 240 is indented toward bottom chamber surface 220 by a predetermined depth in a range between about 4 mm and 10 mm so that an adequate volume of air may be disposed in recess 140. In some embodiments, the depth of recessed portion 240 may be proportional to the size of peripheral chamber 121. For example, in some embodiments, peripheral chambers 121 disposed along lateral and medial rows 127, 128 gradually increase in volume from forward-most peripheral chamber 121 to rearward-most peripheral chamber 121, and a depth of recessed portion 240 may gradually increase in length from forward-most peripheral chamber 121 to rearward-most peripheral chamber 121.

In some embodiments, upper chamber surface 210 of each peripheral chamber 121 may include a recessed portion 240 such that a recess 140 is defined between each peripheral chamber 121 and upper sole 110. In some embodiments, recesses 140 may not be defined in one or more of the peripheral chambers 121 of bladder 120. For example, in some embodiments, one or more peripheral chambers 121 may not include a recessed portion 240 in upper chamber surface 210 such that recesses 140 are not defined between selected peripheral chambers 121 of bladder 120 and upper sole 110. In some embodiments, one or more peripheral chambers 121 located in heel region 101 of sole 100 may not include a recessed portion 240 so that more pressurized fluid may be held in heel region 101 of sole 100 to cushion against the stronger forces applied during heel strike. In one embodiment, the largest peripheral chamber 121 located in heel region 101 of sole 100 may not include a recessed portion 240 so that more pressurized fluid may be held in heel region 101 of sole 100.

In some embodiments, a portion of upper chamber surface 210 surrounding recessed portion 240 may be inclined from edge of recessed portion 240 to outer and inner edges disposed against chamber sidewall 230. In some embodiments, a portion of upper chamber surface 210 surrounding recessed portion 240 may be flat and level against bottom surface 113 of upper sole 110. In some embodiments, upper surface 210 may comprise a ridge 211 defining the perimeter of recessed portion 240 and disposed between associated recess 140 and groove 212. In some embodiments, ridge 211 protrudes above the remaining portions of upper surface 210.

In some embodiments, as shown in FIG. 16, for example, bottom surface 113 of upper sole 110 may include recessed portions 113A, such that the upper surface of bladder 120 and the recessed portions 113A of bottom surface 113 of upper sole 110 collectively define the outer boundary of recess 140. In some embodiments, the recessed portions 113A of bottom surface 113 may be located directly above upper chamber surface 210 of each peripheral chamber 121.

In some embodiments, recesses 140 may not be defined in one or more of the chambers of bladder 120. For example, in some embodiments, central forefoot chamber 123 and central heel chamber 125 may each include an upper surface that does not comprise a recessed portion such that the substantially entire upper surface of central forefoot chamber 123 and central heel chamber 125 is flush against bottom surface 113 of upper sole 110. In some embodiments, central forefoot chamber 123 and central heel chamber 125 may each include an upper surface that comprises a recessed portion such that the bottom surface 113 of upper sole 110 and recessed portions of the upper surface of central forefoot chamber 123 and central heel chamber 125.

In various embodiments, the number, size, and shape of the plurality chambers 121, 123, 125 of bladder 120 may be varied to provide the desired ride characteristics.

In one embodiment, as shown in FIG. 10, for example, bladder 100 may include a total of four peripheral chambers 121 located in heel region 101 of sole 100 and six peripheral chambers 121 located in forefoot region 103 of sole 100, whereby lateral and medial rows 127, 128 each include two peripheral chambers 121 disposed in heel region 101 and three peripheral chambers 121 disposed in forefoot region 103. In other embodiments, bladder 120 may include any number of peripheral chambers 121 in heel region 101 and forefoot region 103 to provide desired support for wearer.

In some embodiments, as shown in FIG. 10, for example, peripheral chambers 121 located in heel region 101 are larger in volume than peripheral chambers 121 located in forefoot region 103. In some embodiments, peripheral chambers 121 disposed along lateral and medial rows 127, 128 gradually increase in volume from forward-most peripheral chamber 121 to rearward-most peripheral chamber 121.

By providing larger volume peripheral chambers 121 in heel region and gradually increasing volume of peripheral chambers 121 from forefoot region 103 to heel region 101 of sole 100, bladder 100 provides added support and cushioning in heel region 101 to account for larger downward force applied by wearer during the heel strike.

In various embodiments, peripheral chambers 121 may include a height in a range between about 7 mm to about 26 mm. In some embodiments, a ratio between height of recessed portion 240 and height of peripheral chamber 121 may range from about 15% to 60% so that an adequate volume of air is held recess 140 and sufficient strength is provided for peripheral chamber 121. In various embodiments, peripheral chambers 121 may include a transverse dimension (e.g., diameter) in a range between about 25 mm and 60 mm depending on location of peripheral chamber 121 along sole 100. For example, peripheral chambers 121 disposed in heel region 101 of sole 100 may comprise a larger transverse dimension than peripheral chambers 121 disposed in forefoot region 103 of sole 100.

In some embodiments, central forefoot chamber 123 and central heel chamber 125 are each triangular in shape, as opposed to the more oval shape of peripheral chambers 121. In some embodiments, central forefoot chamber 123 and central heel chamber 125 are each slightly flatter than the peripheral chambers 121 to account for the lack of force applied toward the center of wearer's heel upon heel strike as compared to amount of force applied against the outer edges of the wearer's heel.

In various embodiments, with reference to FIGS. 1-6, lower sole 130 is coupled to selected portions of a bottom surface of bladder 120 and/or projection 114 of upper sole 110. In some embodiments, lower sole 130 may be coupled to only the bottom surface of chambers 121, 123, 125, peripheral passages 122, and forefoot and heel conduits 124, 126, without being coupled to any portion of upper sole 110. In some embodiments, lower sole 130 is coupled to both the bottom surface of chambers 121, 123, 125, peripheral passages 122, and forefoot and heel conduits 124, 126 and projection 114 of upper sole 110. In some embodiments, lower sole 130 may comprise ridges 132 protruding downward away from sole 100 to increase rigidity and strength of lower sole 130.

In some embodiments, as shown in FIGS. 4-6, for example, lower sole 130 may include an outer edge 134 extending along lateral side 104 and medial side 105 of sole 100. In some embodiment, outer edge 134 of lower sole 130 may be corrugated-shaped and disposed flushed against lower edge 239 defined by chamber sidewalls 230 of peripheral chambers 121 such that an exterior surface of lower sole 130 extends continuously from chamber sidewalls 230 of peripheral chambers 230.

In some embodiments, all or a portion of the lower sole 130 may comprise a wear-resistant material. For example, wear-resistant material for lower sole 130 may include synthetic or natural rubber, thermoplastic polyurethane, a wear-resistant foam, or a combination thereof.

In some embodiments, sole 100 may include an insole and/or sockliner disposed on top surface 112 of upper sole 110.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, the sole comprising:
an upper sole;
a fluid filled bladder coupled to the upper sole, the bladder comprising a plurality of chambers extending below the upper sole; and
a plurality of recesses disposed between the upper sole and the bladder,
wherein the plurality of recesses each define an air pocket between the upper sole and the bladder,
wherein the plurality of chambers comprises a set of peripheral chambers exposed along a lateral side of the sole or a medial side of the sole,
wherein each of the peripheral chambers comprises an upper chamber surface, a bottom chamber surface, and a chamber sidewall, and the upper chamber surface comprises a recess indented toward the bottom chamber surface, and
wherein each of the recesses is defined by a respective recess formed in the upper chamber surface of a respective peripheral chamber.

2. The sole of claim 1, wherein each of the recesses is disposed between a respective chamber and the upper sole.

3. The sole of claim 1, wherein the upper sole comprises a plurality of bulges disposed along the lateral side of the sole and the medial side of the sole, and
wherein each of the bulges is located directly above a respective peripheral chamber.

4. The sole of claim 3, wherein each of the bulges comprises a convex-shaped exterior surface protruding outward from the sole, and
wherein the chamber sidewall of each peripheral chamber extends continuously from the exterior surface of a respective bulge.

5. The sole of claim 3, wherein each of the bulges comprise ribs extending in a vertical direction;
wherein the chamber sidewall of each peripheral chamber comprises ribs extending continuously from the ribs of a respective bulge.

6. The sole of claim 1, wherein the set of peripheral chambers includes a lateral row of peripheral chambers disposed along the lateral side of the sole and a medial row of peripheral chambers disposed along the medial side of the sole.

7. The sole of claim 6, wherein the upper sole comprises an exposed outer lateral edge disposed along a lateral side of the sole, and
wherein the bladder extends beyond the exposed outer lateral edge of the upper sole such that the lateral row of peripheral chambers forms a lateral sidewall of the sole.

8. The sole of claim 6, wherein the upper sole comprises an exposed outer medial edge disposed along a medial side of the sole, and wherein the bladder extends beyond the exposed outer medial edge of the upper sole such that the medial row of peripheral chambers forms a medial sidewall of the sole.

9. The sole of claim 6, wherein the plurality of chambers comprises a central forefoot chamber disposed in a forefoot region of the sole between the medial and lateral rows of peripheral chambers, and wherein the bladder comprises a plurality of forefoot conduits fluidly connecting the central forefoot chamber to the medial and lateral rows of peripheral chambers located in the forefoot region of the sole.

10. The sole of claim 6, wherein the plurality of chambers comprises a central heel chamber disposed in a heel region of the sole between the medial and lateral rows of peripheral chambers, and wherein the bladder comprises a plurality of heel conduits fluidly connecting the central heel chamber to the medial and lateral rows of peripheral chambers located in the heel region of the sole.

11. The sole of claim 6, wherein the upper sole comprises a flat bottom sole surface and a projection extending along the bottom sole surface and disposed between the medial and lateral rows of peripheral chambers, wherein the projection includes a projection wall engaging against at least one peripheral chamber disposed along the lateral side of the sole and at least one peripheral chamber disposed along the medial side of the sole.

12. An article of footwear, comprising:

an upper; and a sole coupled to the upper, the sole comprising:

an upper sole;

a fluid filled bladder coupled to the upper sole, the bladder comprising a plurality of chambers extending below the upper sole; and a plurality of recesses disposed between the upper sole and the bladder, wherein ambient air is disposed within the plurality of recesses between the upper sole and the bladder, wherein the plurality of chambers comprises a set of first chambers, and wherein each of the recesses is disposed between a respective first chamber and the upper sole, and each of the first chambers comprises an upper chamber surface defining a perimeter of the recess, and the upper chamber surface extends around the perimeter of the recess.

13. The article of claim 12, wherein the set of first chambers are exposed along a lateral side of the sole or a medial side of the sole.

14. The article of claim 13, wherein each of the first chambers further comprises a bottom chamber surface and a chamber sidewall, and the upper chamber surface comprises a recess indented toward the bottom chamber surface, wherein each of the recesses is defined by a respective recess formed in the upper chamber surface of a respective peripheral chamber.

15. The article of claim 13, wherein the set of first chambers includes a lateral row of first chambers disposed along a lateral side of the sole and a medial row of first chambers disposed along a medial side of the sole.

16. The article of claim 15, wherein the upper sole comprises an exposed outer lateral edge disposed along the lateral side of the sole and an exposed outer medial edge disposed along the medial side of the sole, and wherein the bladder extends beyond the exposed outer lateral edge and the exposed outer medial edge of the upper sole such that the lateral row of first chambers forms a lateral sidewall of the sole and the medial row of first chambers form a medial sidewall of the sole.

17. The article of claim 16, wherein the bladder is comprised of a blow-molded elastomeric material such that the lateral and medial sidewalls formed by the first chambers are flexible.

18. A sole for an article of footwear, the sole comprising:

an upper sole comprising a foam-based material;

a fluid filled bladder coupled to a bottom surface of the upper sole, the bladder comprising a plurality of chambers extending below the upper sole and a plurality of passages fluidly connecting the plurality of chambers in series; and a plurality of recesses disposed between the upper sole and the bladder, wherein the plurality of recesses each define an air pocket between the upper sole and the bladder, and the bottom surface of the upper sole and a surface of the bladder define a boundary of each air pocket, and wherein the bladder is formed of a blow-molded thermoplastic material such that the plurality of chambers and the plurality of passages are unitary.

19. The sole of claim 18, wherein the plurality of chambers comprises a set of first chambers, and each of the first chambers comprises an upper chamber surface, a bottom chamber surface, and a chamber sidewall, and the upper chamber surface comprises a recessed portion indented toward the bottom chamber surface, wherein the surface of the bladder defining the boundary of the air pocket includes the recessed portion of the upper chamber surface.

20. The sole of claim 18, wherein each of the recesses is disposed between a respective chamber and the upper sole.

21. The sole of claim 18, wherein the bottom surface of the upper sole comprises a plurality of recessed portions, and the plurality of recessed portions define the boundary of each air pocket.

* * * * *